United States Patent [19]

Schweizer

[11] 4,164,839

[45] Aug. 21, 1979

[54] YARN PROCESS

[75] Inventor: Udo P. Schweizer, Charlotte, N.C.

[73] Assignee: Akzona Incorporated, Asheville, N.C.

[21] Appl. No.: 873,758

[22] Filed: Jan. 30, 1978

[51] Int. Cl.[2] ..... D02G 3/38

[52] U.S. Cl. ..... 57/293; 57/341

[58] Field of Search ..... 57/160, 157 TS, 157 F, 57/164, 34 AT

[56] References Cited

U.S. PATENT DOCUMENTS

| | | | |
|---|---|---|---|
| 3,110,151 | 11/1963 | Bunting, Jr. et al. | 57/157 F |
| 3,225,533 | 12/1965 | Henshaw | 57/34 AT |
| 3,685,268 | 8/1972 | Sequin | 57/160 X |
| 3,763,640 | 10/1973 | Nagel et al. | 57/160 X |
| 3,844,103 | 10/1976 | Sasaki et al. | 57/157 TS |
| 3,973,386 | 8/1976 | Gonofa | 57/157 TS |
| 3,999,361 | 12/1976 | Ellis et al. | 57/34 AT |
| 4,010,601 | 3/1977 | Anabara et al. | 57/160 |

*Primary Examiner*—Charles Gorenstein

*Attorney, Agent, or Firm*—Francis W. Young; Tom R. Vestal

[57] ABSTRACT

The invention relates to a process for the manufacture of a core/skin or core/sheath yarn, whose skin- or sheath-forming filament is wrapped around the core yarn in alternating "S" and "Z" directions. It relates furthermore to a device to carry out the process using otherwise known single spindle friction falsetwisting units.

7 Claims, 9 Drawing Figures

YARN PROCESS

Processes and apparatus to make so-called core-skin or sheath-core yarn are known. For instance, German Patent Disclosure 1,908,219 describes a process for the manufacture of a wool-like blend yarn consisting of a core filament and one or more skin filaments, whereby a multifilament yarn forming the core yarn converges with one or more other multifilament yarns in a perpendicular or nearly perpendicular direction with respect to the axis of the former yarn within a falsetwisting zone. The total yarn may subsequently be subjected to a second thermal treatment followed by twisting.

In another known process (French Pat. No. 1,251,346), two ends are fed before the heating device of a falsetwisting zone at differential speeds to a yarn guide eyelet at a stationary location accurately defining the point of convergence, from where they are fed jointly to the falsetwisting device. However, this process does not yield a core-skin yarn, but rather the two ends converging before the falsetwisting device travel strictly side-by-side after emerging from said device.

U.S. Pat. No. 3,685,268 discloses a method and apparatus for preparing fancy yarns by feeding a sheath (effect) yarn in excess of the feed rate of the core yarn and contacting the two with a constantly contacted rotating frictional surface wherein the twist of the effect yarn is unidirectional—S or Z as those terms are used in the trade. A similar yarn is made using the method and apparatus of U.S. Pat. No. 3,309,863 incorporating a spindle-type falsetwist device. Also, U.S. Pat. No. 3,403,501 discloses method and apparatus for unidirectionally twisting a sheath or effect yarn around a core yarn by means of a pneumatic twisting device.

U.S. Pat. No. 3,691,750 discloses a manner of making a sheath/core yarn in which the wrapping (sheath) yarn has alternating S and Z twisting of apparently random nature. The alternating wrap is achieved by selecting denier differences, draw ratio differences, and the like. The method employed therein for making the sheath-/core yarn is drawing and falsetwist texturing two yarns simultaneously. Although Example 5 indicates that the feed roll utilized for the Example is stepped and that the feed speed for the sheath yarn was 18% greater, the yarns were undrawn. The core yarn was, therefore, drawn 18% greater than the sheath yarn.

U.S. Pat. No. 4,002,017 discloses a friction falsetwisting device having longitudinal grooves in a hard material extending parallel to the axis of rotation to increase the friction characteristics and life of the device over elastic and plastic surfaces of conventional falsetwist devices.

BRIEF DESCRIPTION OF THE INVENTION

The technical objective on which the invention is based consists of manufacturing a core-skin yarn wherein the skin yarn is wrapped in alternating "S" and "Z" directions.

This objective is solved according to the invention by a process for the manufacture of a core-skin yarn whose skin-forming yarn is wrapped on the core yarn in alternating "S" and "Z" directions, inasmuch as the core yarn being falsetwisted progresses laterally at an overfeed rate of at least 10% to the input point of the falsetwisting unit, while forming with the core yarn an angle of at least 15°, both yarns running jointly on the falsetwisting friction surface which moves essentially perpendicularly to the general yarn travel direction, whereby the friction contact of the yarn with the friction surface is reduced at very short time intervals briefly to less than about 50% of the normal value, and under certain conditions to 0. The "normal value" of the friction contact refers to such contact obtained, under retention of other parameters, in the absence of the measures producing a short-lived reduction of the friction contact.

The core-skin yarn can subsequently be treated to insure sufficient slippage resistance, followed by winding. The overfeed rate of the skin yarn can in an advantageous further development amount to about 20–50%; furthermore, the number of reductions in friction contact per minute lies advantageously at a ratio to the core yarn velocity in m/min between about 10:1 and 350:1; whereas, depending on the selected yarn speed, ratios up to 600:1 may be quite expedient.

According to the invention, the required resistance to slippage can be provided by otherwise known means such as size application, treatments with blowing air which tangle individual filaments together without loop formation, by retwisting with a so-called cross twist, etc. According to the invention, the skin yarn in a preferred version can be textured yarn obtained by a crimping treatment.

It may be advantageous if between emergence from the working area of the friction falsetwisting device and application of the slippage resistant treatment, the core-skin yarn came only in contact with such thread guiding devices whose surface follows the yarn movement, for example, thread guide rolls.

A device according to the invention to carry out the process of the invention which is based on otherwise known single spindle falsetwisting units, is characterized in that the working surface of individual friction falsetwisting units is provided with one or more notches around the circumference with which the yarn makes contact. It has been found advantageous that the unmodified working surface of the falsetwisting unit compose at least 25% of the total surface. On the other hand, it is advantageous that the notches cover at least 25% of the total working surface coming in contact with the yarn. In one version of the invention, the notches are asymmetrical inasmuch as in the direction of rotation the front edge drops steeply whereas the rear of the notches rises gradually to reach the level of the normal working surface.

A very significant change in the character of the finished product is obtained via the distance of the twist reversal points of the covering yarn, as well as via the intensity or density with which the latter is wrapped on the core yarn. It has been found that these characteristics can be significantly influenced by the overfeed of the covering yarn as well as by yarn tension conditions. However, the limit is not strictly set and can be influenced by a series of factors such as material being used, yarn and individual filament denier, number of filaments, falsetwisting unit being used, number of notches on the circumference, so that overfeed rate and yarn tensions producing the desired results are best determined empirically.

The effect of the measures according to the invention was surprising. While it was unquestionably established that the brief decline in yarn tension, for example while the yarn drops into a notch, is causative of the phenomenon of alternating winding directions; it has, however, been simultaneously found that the distance between the reversal points of the winding direction are not dictated by a simple ratio between yarn velocity and rotational speed of the falsetwisting unit, but may be made to deviate substantially by modification of the earlier mentioned factors. It appears, however, likely that the frequency of yarn tension changes based on the yarn velocity represents the lower limit for the distances between reversal points to the effect that the reversal points per time unit cannot exceed, for example the number, per time unit, of yarn contacts with the areas located between the notches.

DETAILED DESCRIPTION OF THE DRAWINGS

Figure 1:
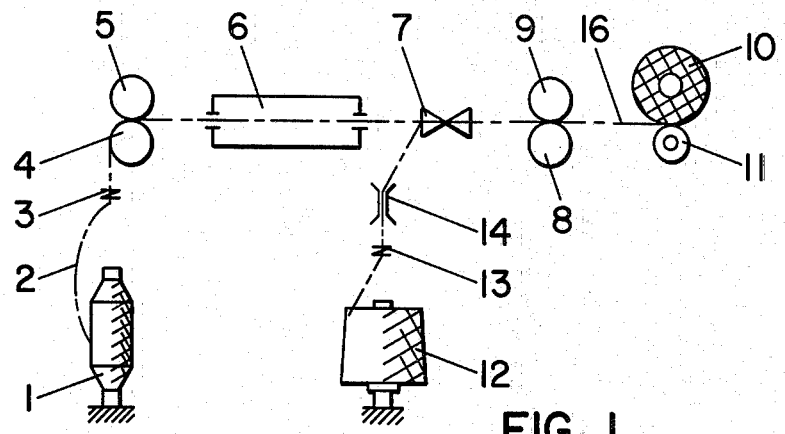
FIG. 1 represents a schematic drawing of a device to carry out the process of the invention.

FIG. 1 is a schematic drawing of the device to carry out the process according to the invention. Multifilament core yarn 2, from a feeder roll 1 is drawn off via thread guide 3 through first supply rolls 4 and 5, travels through a setting device 6, then to a single spindle friction falsetwisting unit 7 of a known type and second supply rolls 8 and 9 to winding spool 10 driven by drive roll 11. A second multifilament yarn which may have a falsetwisting crimp travels from a second feeder spool 12 via thread guide 13 and yarn tension device 14 to core yarn 3 with which it converges between the setting device 6 and falsetwisting unit 7, then travels together with the latter through the falsetwisting device. The two filaments emerge jointly as core-skin yarn having a skin 16 with alternating "S" and "Z" twist according to the invention and are wound into a package.

Figure 1A:
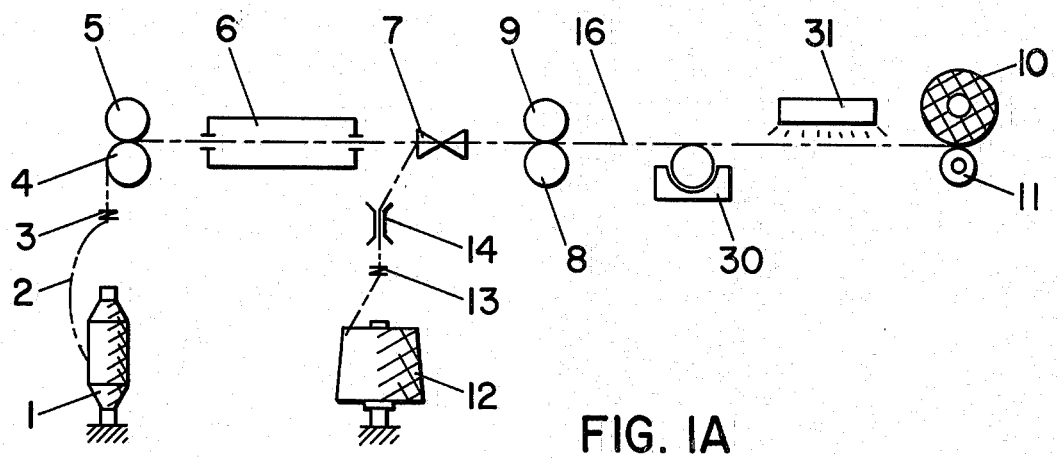
FIG. 1A represents the schematic drawing of FIG. 1 including a sizing step.
Figure 1B:
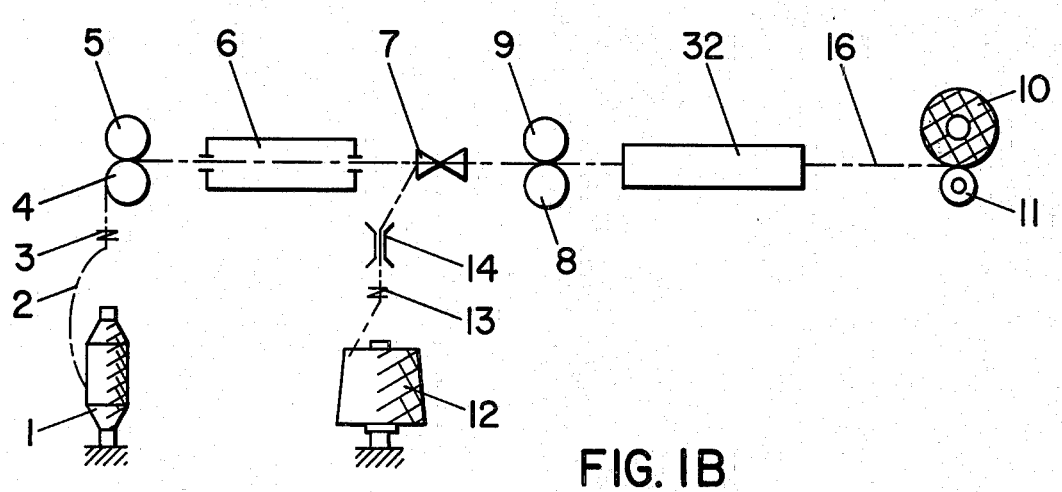
FIG. 1B represents the schematic drawing of FIG. 1 including a tangling step.

A sizing device 30 to apply a slippage-resistant size with subsequent drying unit 31 may be installed between second supply unit 8, 9 and winding unit 10, 11 as in FIG. 1A. Depending on the density of the yarn emerging from the falsetwister, instead of a size application, a tangling device 32 can be used to tangle the individual filaments forming the yarn as in FIG. 1B, whereby the tangling knots produced thereby occur essentially at the reversal points of the winding direction of the skin yarn.

Figure 1C:
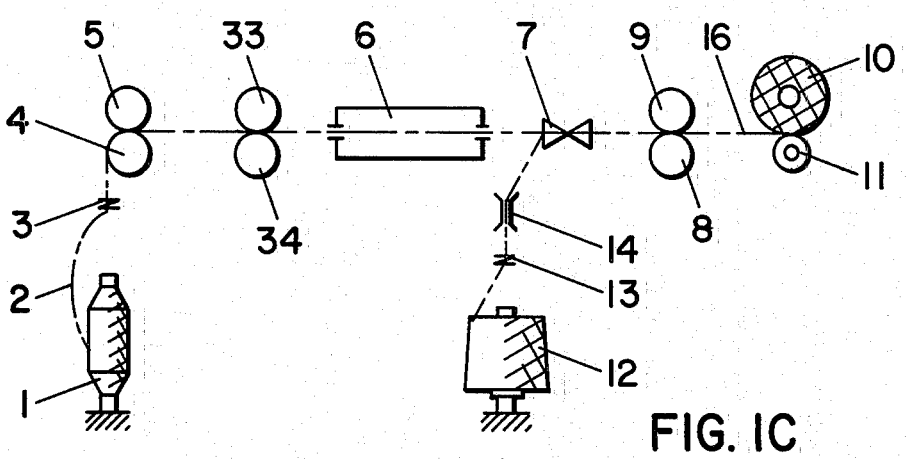
FIG. 1C represents the schematic drawing of FIG. 1 including a drawing step.

To carry out the process of the invention it is not absolutely essential to use a feeder spool 1 of drawn material. The process of the invention can also be integrated into a drawtexturing process, whereby it is, however, expedient to use a so-called sequential process, so that the yarn entering the setting device 6 is drawn. To this end, the rolls 4, 5 can be used as supply rolls; the yarn would then be drawn between rolls 4 and 5 and 33 and 34 as in FIG. 1C.

Figure 5:
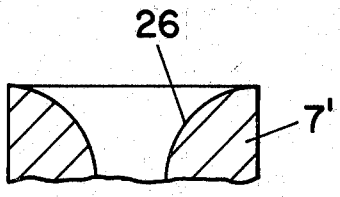
FIG. 5 PRIOR ART
FIG. 5 is a longitudinal cross section of a known friction falsetwisting unit.
Figure 6:
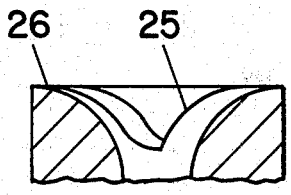
FIG. 6 is a longitudinal cross section of a friction falsetwisting unit of the invention.
Figure 3:
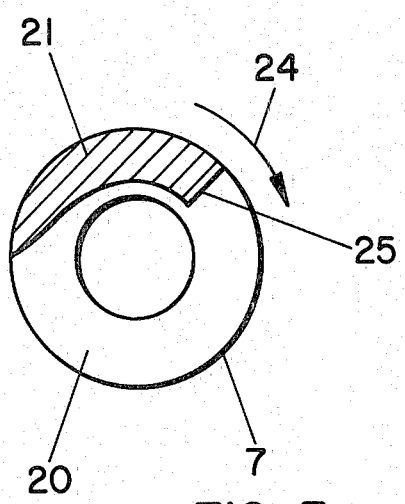
FIG. 3 is a plane view of the working area of a friction falsetwisting unit with one notch.
Figure 4:
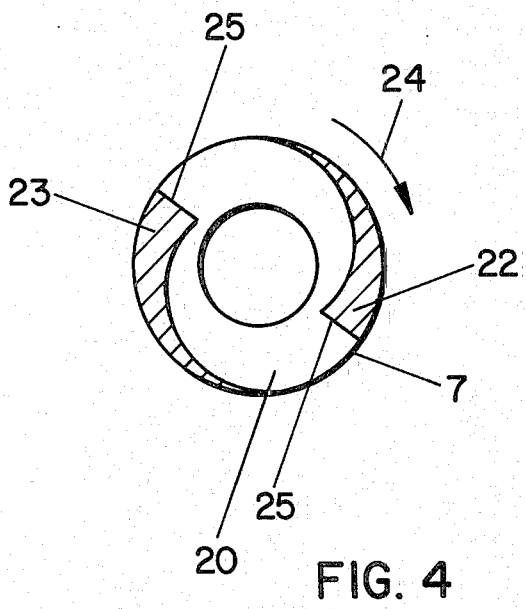
FIG. 4 is similar to FIG. 3, however with 2 notches.

Friction falsetwisting unit 7 is a single spindle unit of generally known design (such as in U.S. Pat. No. 3,948,034) on which the yarn travels on a revolving friction plane, which is preferably leaning toward and essentially perpendicular to the yarn travel direction. This friction surface is designed according to the invention so that during one revolution of the friction surface one or more changes in yarn tension take place. This can be achieved by notches provided in the friction surface, as shown in FIGS. 3, 4 and 6. FIG. 5 illustrates friction unit 7' according to the state of the art. This is contrasted in FIG. 3 by friction surface 26 of falsetwisting unit 7 according to the invention exhibiting notch 21. Shaded surface 21 (shading was provided for clarity) represents the notch. It is produced by cutting a corresponding piece from the friction surface 26, as shown in FIG. 6. Thereby, edge 25 located in the yarn travel direction, although preferably slightly rounded, will nevertheless drop rather sharply, whereas from the lowest point the notch will rise gradually till it reaches the level of working surface 26. The depth of notches 21, 22 is not shown to scale, according to the invention, it may be between 0.5 and 10 mm, or more for heavier deniers and depends on the dimensions of the friction ring being used, especially height, ID, OD and surface radius measured in cross section, and furthermore upon the yarn denier being processed.

While FIGS. 3 and 4 illustrate only the possibilities with 1 or 2 notches, 21, 22 on the circumference of the friction surface 26, the number of notches may be greater and is dictated in particular by the size or diameter of friction area 26, by the operating rpm being contemplated and the yarn denier to be used.

Figure 2:
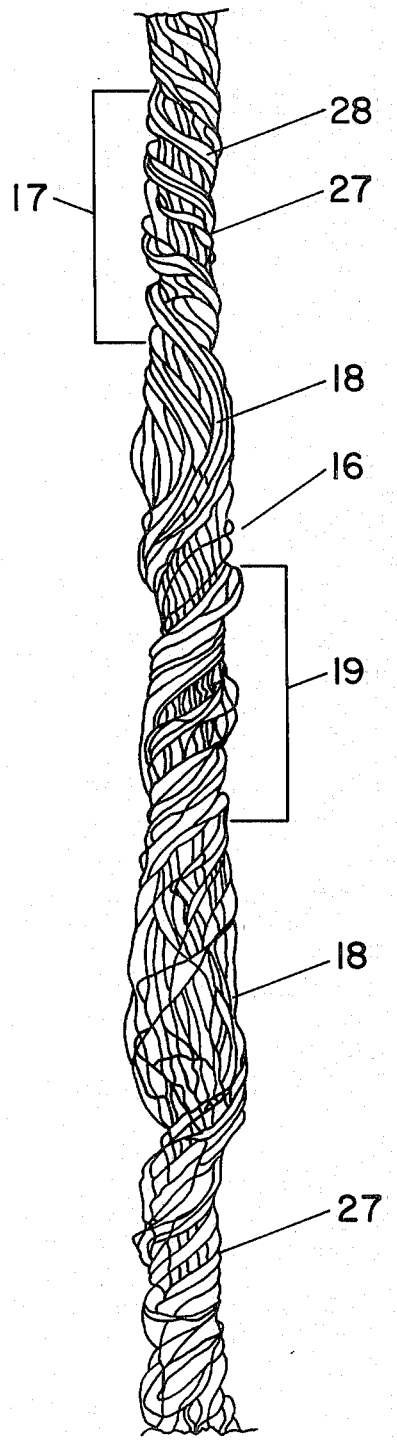
FIG. 2 illustrates a yarn according to the invention.

FIG. 2 illustrates a core-skin yarn 16 obtained according to the method of the invention. The core yarn 27 is covered, in varying density by skin yarn 28, whereby the winding direction alternates at irregular intervals between an "S" and a "Z" twist. For instance, at 17 one can clearly see a "Z" twist of the covering yarn, whereas at 19 a twist in S direction is visible. Between these two points there is also a clearly outlined reversal point 18. Another reversal point 18 is visible at the lower end of the illustrated length of yarn, however in a relatively open form.

By variation of the yarn tension, the number of notches on the circumference of the friction surface, the rotational speed of the friction unit, the depth of the notches, the yarn velocity, etc., the yarn appearance especially as regards wrapping density and distance between reversal points can be influenced greatly.

What is claimed is:

1. A method of making a sheath/core yarn, wherein a sheath yarn is wrapped around the core yarn in alternating "S" and "Z" directions, comprising the steps of feeding the core yarn at a determined velocity rate to a false twisting device, feeding a sheath yarn to the false twist device at a velocity rate greater than the core yarn and at an angle to the core yarn of at least 15° to combine the yarns, reducing contact of the sheath and core yarns with the false twist device for short-time intervals to less than fifty percent of the normal contact level wherein the ratio of the number of reductions in contact with the falsetwisting device per minute to the velocity of the core yarn in meters per minute is between about 10:1 and 350:1, removing the sheath and core yarns from the falsetwist device and thereafter winding the combined yarns into a package.

2. The method of claim 1, wherein the contact level of the sheath and core yarns with the falsetwisting device is periodically reduced to zero.

3. The method of claim 1, wherein the combined sheath and core yarns are treated with a slippage resisting sizing before winding.

4. The method of claim 1, wherein the combined sheath and core yarns are tangled before winding.

5. The method of claim 1, wherein the sheath yarn is fed to the falsetwist device at a velocity rate of 20% to 50% greater than the core yarn.

6. The method of claim 1, including texturing the sheath yarn before combining with the core yarn.

7. A method of making a sheath/core yarn comprising the steps of: feeding an undrawn core yarn to a draw zone, withdrawing the core yarn at a faster determined rate to orient the crystalline structure of the core yarn, feeding the core yarn to a friction falsetwisting device, feeding a sheath yarn to the friction falsetwisting device at a velocity rate greater than the core yarn to combine the yarns, and reducing the contact of the yarns with the friction falsetwist device for short-time intervals to less than 50% of the normal contact level, wherein the ratio of the number of reductions in contact with the falsetwisting device per minute to the velocity of the core yarn in meters per minute is between about 10:1 and 350:1.

* * * * *